US007571737B2

(12) United States Patent
Jang

(10) Patent No.: US 7,571,737 B2
(45) Date of Patent: Aug. 11, 2009

(54) JOINT STRUCTURE OF FOLD TYPE TENT FRAME

(76) Inventor: Jeongwoo Jang, 1439, Sangin-dong, Dalseo-gu, Daegu, Dalseo-gu (KR) 704-817

( * ) Notice: Subject to any disclaimer, the term of this patent is extended or adjusted under 35 U.S.C. 154(b) by 0 days.

(21) Appl. No.: 11/882,362

(22) Filed: Aug. 1, 2007

(65) Prior Publication Data

US 2008/0078433 A1 Apr. 3, 2008

(30) Foreign Application Priority Data

Aug. 1, 2006 (KR) ..... 20-2006-0020667

(51) Int. Cl.
*E04H 15/48* (2006.01)

(52) U.S. Cl. ..... 135/146; 135/131; 135/151; 135/144; 403/170; 403/231

(58) Field of Classification Search ..... 135/121–122, 135/130, 131, 135, 143–147, 151–153, 120.3; 403/64, 169, 170, 172, 174, 178, 217, 231; 248/170–173, 297; 52/109, 79.5, 646, 656.1, 52/656.9; 446/126, 111–113; 297/42, 106
See application file for complete search history.

(56) References Cited

U.S. PATENT DOCUMENTS 2,723,673 A * 11/1955 Call ..... 135/140
4,077,418 A * 3/1978 Cohen ..... 135/95
4,105,348 A * 8/1978 Anderson et al. ..... 403/172
4,347,690 A * 9/1982 Wallace, Jr. ..... 52/93.1
4,505,609 A * 3/1985 Vella ..... 403/91
4,607,656 A 8/1986 Carter
4,995,212 A * 2/1991 Morgan et al. ..... 52/646
5,125,205 A * 6/1992 Wichman ..... 52/646
5,350,331 A * 9/1994 Glickman ..... 446/126
5,421,356 A 6/1995 Lynch
5,701,923 A * 12/1997 Losi et al. ..... 135/131
5,794,640 A 8/1998 Jang
5,927,363 A * 7/1999 Olsen ..... 160/83.1
6,152,157 A * 11/2000 Jang ..... 135/131
6,672,980 B1 * 1/2004 Walsh ..... 473/478
6,848,461 B2 * 2/2005 Tsai ..... 135/131

(Continued)

FOREIGN PATENT DOCUMENTS

KR 200321298 7/2003

*Primary Examiner*—Winnie Yip
(74) *Attorney, Agent, or Firm*—Cantor Colburn LLP

(57) ABSTRACT

A joint structure of a fold type tent frame is provided. In the present invention the joint structure includes a plurality of pillars which support a tent, a plurality of horizontal frames which are supported by the pillars to form a roof, and a plurality of connectors which connect between the pillars and the frames and between the frames as a joint structure, includes semicircular rotators which are disposed at end portions of the frames and have bolt holes formed at central portions of the rotators, coupling parts disposed at each of the connectors to have coupling plates with bolt holes and upper coupling plates perpendicular to the coupling plates such that the rotators are coupled to the coupling parts, guide grooves or guide protrusions formed on the upper coupling plates at the inner side of the coupling parts, and guide protrusions or guide grooves formed on outer peripheral surfaces of the semicircular rotators to correspond to the guide grooves or guide protrusions.

2 Claims, 5 Drawing Sheets

U.S. PATENT DOCUMENTS 6,981,350 B1 * 1/2006 Redmon ..... 52/646
7,409,963 B2 * 8/2008 Mallookis et al. ..... 135/144
2005/0028856 A1 * 2/2005 Seo ..... 135/131

* cited by examiner

FIG. 1 *Prior Art*

JOINT STRUCTURE OF FOLD TYPE TENT FRAME

BACKGROUND OF THE INVENTION

1. Field of the Invention

The present invention relates to a joint structure of a fold type tent frame, and more particularly to a joint structure of a fold type tent frame, wherein guide protrusions formed at rotators, locking grooves vertically formed at ends of the guide protrusions, and their corresponding guide grooves and locking projections having a specified height formed at coupling parts are coupled to each other by bolts, thereby increasing a coupling force between the rotators and the coupling parts of each connector without unfastening the bolts even in frequent rotations of the rotators, maintaining a constant angle of the frames coupled in the shape of scissors by the locking projections having a specified height, and preventing damage to a coupling portion of frames.

2. Description of the Prior Art

In general, a fold type tent includes a tent frame including pillars which support a tent and connection frames connected to the respective pillars, and an upper cover covering the upper portion of the tent frame to block sunlight.

As shown in FIG. 1, the tent frame includes top connectors 10 coupled to upper ends of four pillars, slide connectors 20 coupled to the pillars at the lower side of the top connectors 10 to vertically slide along the pillars, side upper and lower connectors 25*a* and 25*b*, upper and lower connectors 30*a* and 30*b*, central upper and lower connectors 31*a* and 31*b*, and various frames arranged between the connectors.

Particularly, side connection frames 70 are diagonally arranged between the side upper connectors 25*a* and the slide connectors 20 and between the side lower connectors 25*b* and the top connectors 10, respectively. The side connection frames 70 overlap each other in the shape of scissors, and the overlapping portions are tied up by fixing bolts 90.

Meanwhile, main connection frames 80 are connected between the upper connectors 30*a* and the slide connectors 20. Each of support frames 40 is connected to each of the top connectors 10, and one end portion of the support frame 40 is fixed to one side surface of each of the main connection frames 80. One end portion of a connection frame 50 is fixed to one side surface of the support frame 40. The other end portion of the connection frame 50 is fixedly coupled to one end portion of an auxiliary connection frame 60. The other end portion of the auxiliary connection frame 60 is coupled to each of the lower connectors 30*b*. Upper connection frames 51 which are coupled to each other in the shape of scissors are connected to the upper and lower connectors 30*a* and 30*b*, respectively. Further, the upper connection frames 51 are connected to the central upper and lower connectors 31*a* and 31*b*, respectively.

The joint structure of connecting the respective connectors and frames has been variously proposed. For example, coupling pieces are formed on each of the connectors and the coupling pieces includes one side coupling piece with a semicircular cut-off groove and the other side coupling piece with a screw coupling hole. An end portion of each frame connected to each connector includes a rotator having a circular rotation protrusion which is coupled to the cut-off groove of the one side coupling piece. The rotator is fixed to the other side coupling piece by fastening a screw in a screw coupling hole formed at the center of the rotation protrusion.

However, according to the above-mentioned joint structure, when the tent frame is folded, the rotator is rotated with vibration, and an excessive force is applied to the other side coupling piece coupled to the rotator. Accordingly, it causes damage to the other side coupling piece, thereby decreasing an entire durability and having difficulty in maintaining an angle of the frame.

SUMMARY OF THE INVENTION

Therefore, the present invention has been made in view of the above problems, and it is an object of the present invention to provide a joint structure of a fold type tent frame, wherein guide protrusions formed at rotators, locking grooves vertically formed at ends of the guide protrusions, and their corresponding guide grooves and locking projections having a specified height formed at coupling parts are coupled to each other by bolts, thereby increasing a coupling force between the rotators and the coupling parts of each connector without unfastening the bolts even in frequent rotations of the rotators, maintaining a constant angle of the frames coupled in the shape of scissors by the locking projections having a specified height, and preventing damage to a coupling portion of frames.

In accordance with an aspect of the present invention, there is provided a joint structure of a fold type tent frame including a plurality of pillars which support a tent, a plurality of horizontal frames which are supported by the pillars to form a roof, and a plurality of connectors which connect between the pillars and the frames and between the frames as a joint structure, comprising: semicircular rotators which are disposed at end portions of the frames and have bolt holes formed at central portions of the rotators; coupling parts disposed at each of the connectors to have coupling plates with bolt holes and upper coupling plates perpendicular to the coupling plates such that the rotators are coupled to the coupling parts; guide grooves or guide protrusions formed on the upper coupling plates at the inner side of the coupling parts; and guide protrusions or guide grooves formed on outer peripheral surfaces of the semicircular rotators to correspond to the guide grooves or guide protrusions formed on the upper coupling parts.

By such a configuration, it is possible to ensure excellent coupling between the rotators and the coupling parts of each connector without unfastening the bolts even in frequent rotations of the rotators, thereby allowing a smooth operation.

Preferably, locking projections having a specified height are vertically formed at ends of the guide grooves or the guide protrusions of the upper coupling plates, and locking grooves are vertically formed at ends of the guide protrusions or the guide grooves of the rotators. Thus, it is possible to maintain a constant angle of the frames coupled in the shape of scissors.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, there will be described an embodiment in which a joint structure according to the present invention is applied to the joint structure of a fold type tent frame which has the same configuration as one described in the prior art.

The joint structure of the fold type tent frame according to the present invention may be also applied to a joint structure of another type of fold type tent frame which is configured with fold type frames forming a pillar and a roof.

Figure 1:
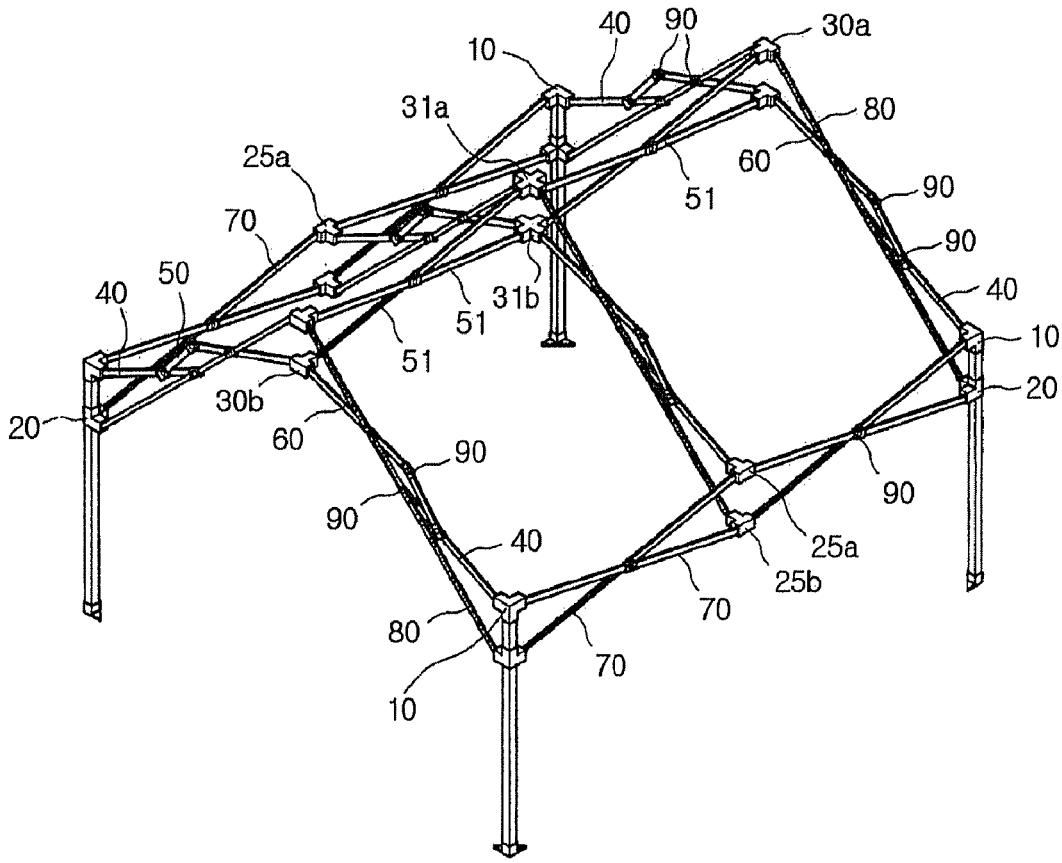
FIG. 1 illustrates an exemplary diagram showing a configuration of a conventional tent frame.
Figure 2:
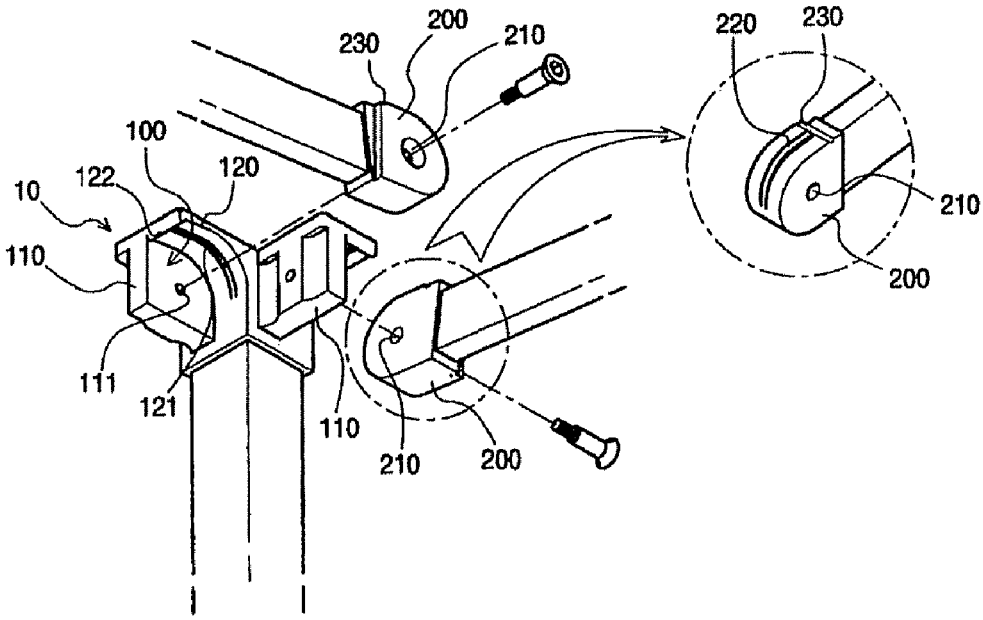
FIG. 2 shows a joint configuration at a top connector in a joint structure of a fold type tent frame according to the present invention.
Figure 3:
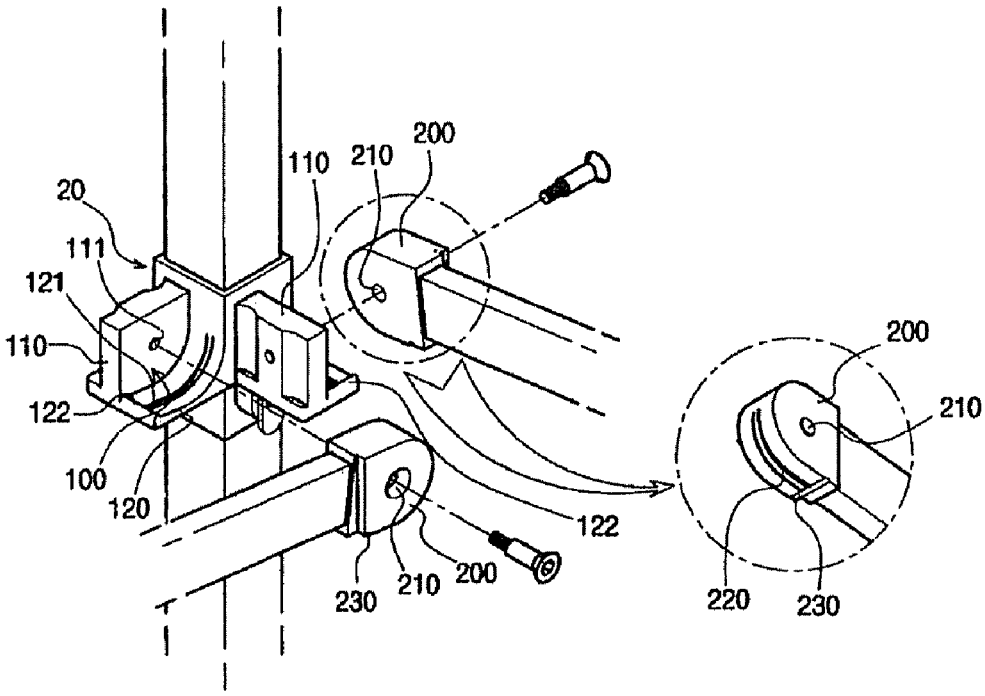
FIG. 3 shows a joint configuration at slide connectors in the joint structure of the fold type tent frame according to the present invention.
Figure 4A:
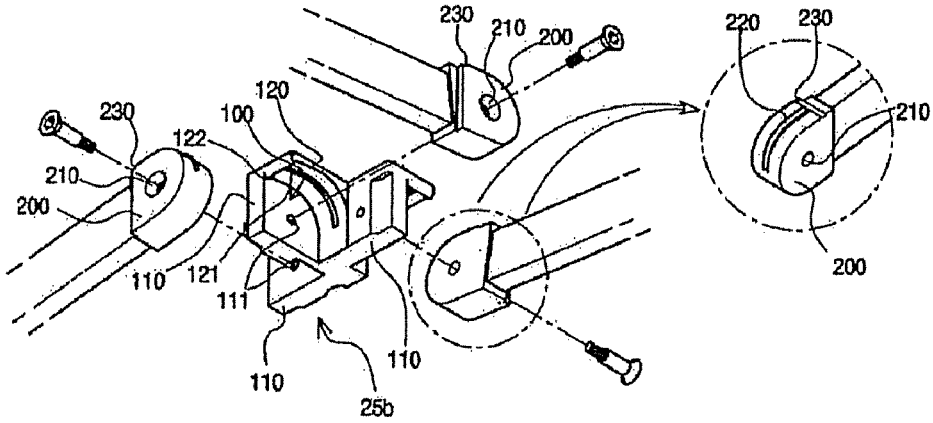
FIGS. 4A and 4B show a joint configuration at side upper and lower connectors in the joint structure of the fold type tent frame according to the present invention.
Figure 4B:
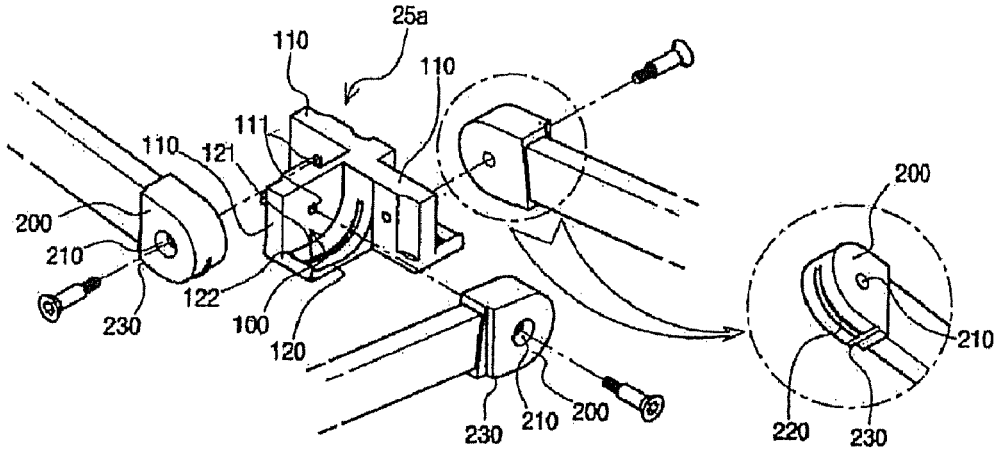
Figure 5:
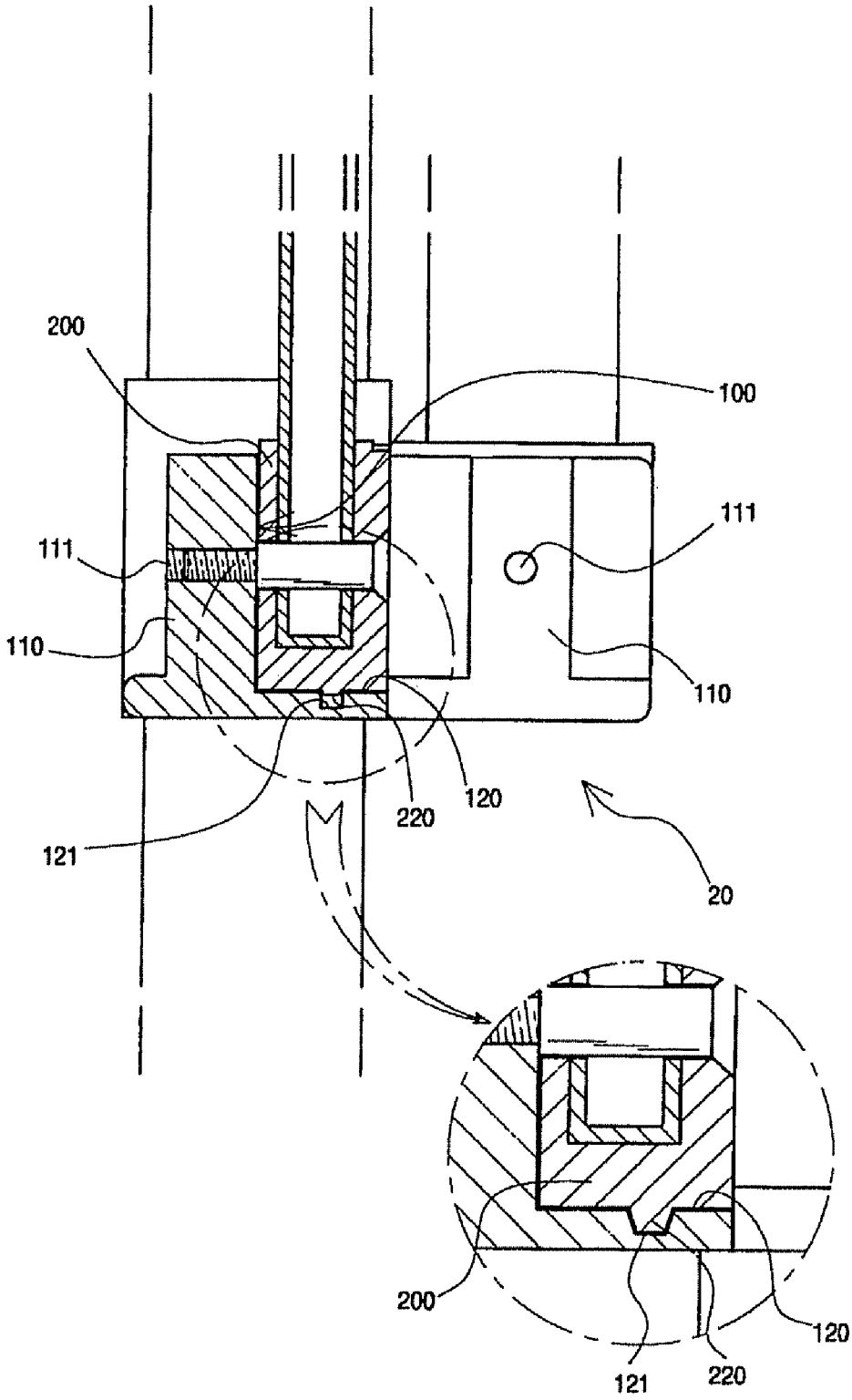
FIG. 5 shows a cross-sectional view of the joint structure of the fold type tent frame according to the present invention.
Figure 6A:
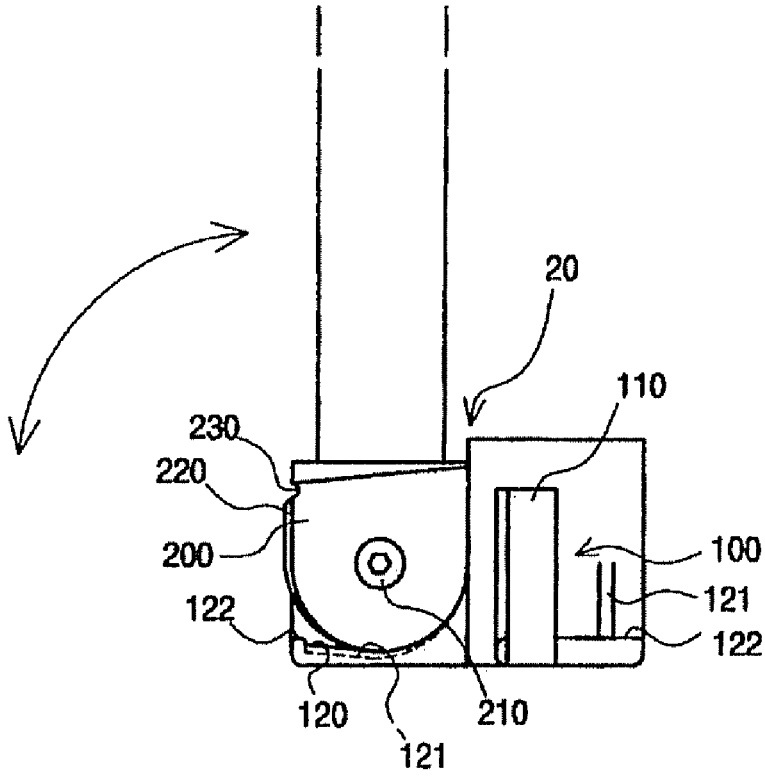
FIGS. 6A and 6B show a joint operation of the fold type tent frame according to the present invention.
Figure 6B:
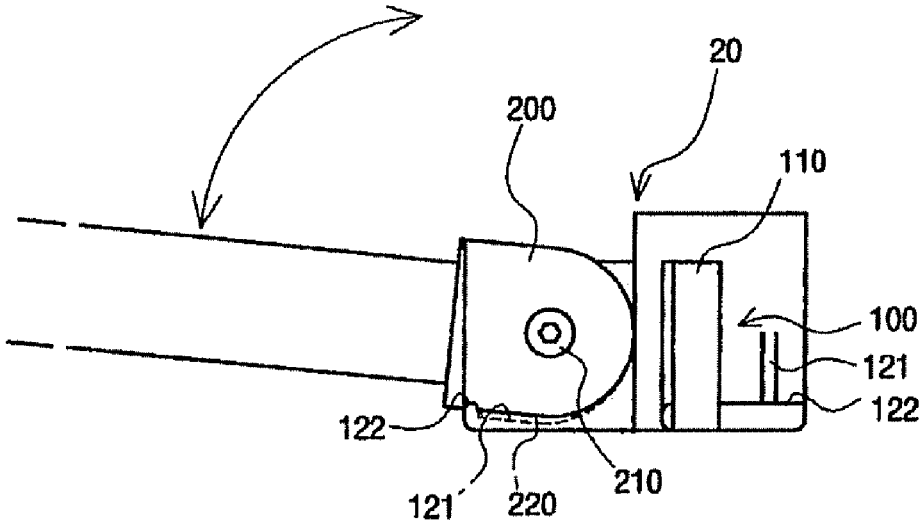

FIG. 2 shows a joint configuration at a top connector in the joint structure of the fold type tent frame according to the present invention. FIG. 3 shows a joint configuration at a slide connector in the joint structure of the fold type tent frame according to the present invention. FIGS. 4A and 4B show a joint configuration at side upper and lower connectors in the joint structure of the fold type tent frame according to the present invention. FIG. 5 shows a cross-sectional view of the joint structure of the fold type tent frame according to the present invention. FIGS. 6A and 6B show a joint operation of the fold type tent frame according to the present invention.

First, referring to FIG. 2, a joint is configured by coupling a top connector 10 and rotators 200 connected to frames. Bolt holes 111 are formed on coupling plates 110 of the top connector 10 and upper coupling plates 120 are provided to be perpendicular to the coupling plates 110, thereby forming coupling parts 100. Guide grooves 121 are formed on the upper coupling plates 120 at the inner side of the coupling parts 100. Locking projections 122 having a specified height are vertically formed at ends of the upper coupling plates 120.

Further, frame coupling grooves are formed on lower portions such that the frames are inserted into upper semicircular portions of the rotators 200. Bolt holes 210 are formed at central portions of the rotators 200. Guide protrusions 220 are formed on outer peripheral surfaces of the upper semicircular portions to correspond to the guide grooves 121. Locking grooves 230 are vertically formed at ends of the rotators 200.

Then, the joint is configured by coupling the rotators 200 to the coupling parts 100 of the top connector 10 using bolts.

In this case, the guide protrusions 220 of the rotators 200 are inserted into the guide grooves 121 of the top connector 10, thereby guiding the rotation of the rotators 200 coupled to the coupling parts 100 of the top connector 10 when a tent is folded or unfolded, or preventing forward and backward movement of the rotators 200 in the rotation.

Further, when the tent is unfolded, the locking projections 122 of the top connector 10 which have a specified height are stably coupled to the locking grooves 230 formed on the rotators 200. Since the locking projections 122 have a specified height, it prevents damage to a coupling portion of frames coupled in the shape of scissors.

Referring to FIGS. 3, 5, 6A and 6B, a joint is configured by coupling a slide connector 20 and rotators 200 connected to frames. Bolt holes 111 are formed on coupling plates 110 of the slide connector 20 and upper coupling plates 120 are provided to be perpendicular to the coupling plates 110, thereby forming coupling parts 100. Guide grooves 121 are formed on the upper coupling plates 120 at the inner side of the coupling parts 100. Locking projections 122 having a specified height are vertically formed at ends of the upper coupling plates 120.

Further, frame coupling grooves are formed on lower portions such that the frames are inserted into upper semicircular portions of the rotators 200. Bolt holes 210 are formed at central portions of the rotators 200. Guide protrusions 220 are formed on outer peripheral surfaces of the upper semicircular portions to correspond to the guide grooves. Locking grooves are vertically formed at ends of the rotators 200.

Then, the joint is configured by coupling the rotators 200 to the coupling parts 100 of the slide connector 20 using bolts.

In this case, the guide protrusions 220 of the rotators 200 are inserted into the guide grooves 121 of the slide connector 20, thereby guiding the rotation of the rotators 200 coupled to the coupling parts 100 of the slide connector 20 when a tent is folded or unfolded, or preventing forward and backward movement of the rotators 200 in the rotation.

Referring to FIGS. 4A and 4B, joints are configured by coupling side upper and lower connectors 25a and 25b and rotators 200 connected to frames. Bolt holes 111 are formed on coupling plates 110 of the side upper and lower connectors 25a and 25b and upper coupling plates 120 are provided to be perpendicular to the coupling plates 110, thereby forming coupling parts 100. Guide grooves 121 are formed on the upper coupling plates 120 at the inner side of the coupling parts 100. Locking projections 122 having a specified height are vertically formed at ends of the upper coupling plates 120.

Further, frame coupling grooves are formed on lower portions such that the frames are inserted into upper semicircular portions of the rotators 200. Bolt holes 210 are formed at central portions of the rotators 200. Guide protrusions 220 are formed on outer peripheral surfaces of the upper semicircular portions to correspond to the guide grooves 121 and the locking projections 122. Locking grooves 230 are vertically formed at ends of the rotators 200.

Then, the joint are configured by coupling the rotators 200 to the coupling parts 100 of the side upper and lower connectors 25*a* and 25*b* using bolts.

In this case, the guide protrusions 220 of the rotators 200 are inserted into the guide grooves 121 of the side upper and lower connectors 25*a* and 25*b*, thereby guiding the rotation of the rotators 200 coupled to the coupling parts 100 of the slide connector 20 when a tent is folded or unfolded, or preventing forward and backward movement of the rotators 200 in the rotation.

Further, in the above-described joint structures, the guide protrusions 220 which are formed on outer peripheral surfaces of the upper semicircular portions of the rotators 200 may be formed in a trapezoid shape. Further, the guide grooves 121 of the coupling parts 100 corresponding to the guide protrusions 220 may be also formed in a trapezoid shape. Then, the joints are configured by bolt coupling, thereby facilitating the coupling and decreasing a friction coefficient. Accordingly, the movement of the joints is facilitated and it is possible to fold or unfold the tent frame with very little force.

Besides, the joints may be configured by coupling the upper and lower connectors 30*a* and 30*b* with the rotators 200 connected to the frames or by coupling the central upper and lower connectors 31*a* and 31*b* with the rotators 200 connected to the frames in the same manner as described above.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A joint structure of a fold type tent frame including a plurality of pillars which support a tent, a plurality of horizontal frames which are supported by the pillars to form a roof, and a plurality of connectors which connect between the pillars and the frames and between the frames as a joint structure, comprising:

semicircular rotators which are disposed at end portions of the frames and have bolt holes formed at central portions of the rotators;

coupling parts disposed at each of the connectors to have coupling plates with bolt holes and upper coupling plates perpendicular to the coupling plates such that the rotators are rotatably coupled to the coupling parts;

guide grooves or guide protrusions formed on the upper coupling plates at the inner side of the coupling parts; and guide protrusions or guide grooves formed on outer peripheral surfaces of the semicircular rotators to correspond to the guide grooves or guide protrusions, wherein locking projections having a specified height are vertically formed at ends of the upper coupling plates of the coupling parts and locking grooves are vertically formed at ends of the rotators.

2. The joint structure of the fold type tent frame according to claim 1, wherein the guide protrusions are embossed in a trapezoid shape and the guide grooves corresponding to the guide protrusions are engraved in an inverse trapezoid shape.

* * * * *